US010622774B2

(12) United States Patent
Washio et al.

(10) Patent No.: US 10,622,774 B2
(45) Date of Patent: Apr. 14, 2020

(54) JOINT CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kazuhiro Washio, Mie (JP); Yasuo Omori, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 215 days.

(21) Appl. No.: 15/563,658

(22) PCT Filed: Apr. 4, 2016

(86) PCT No.: PCT/JP2016/061012
§ 371 (c)(1),
(2) Date: Oct. 2, 2017

(87) PCT Pub. No.: WO2016/170958
PCT Pub. Date: Oct. 27, 2016

(65) Prior Publication Data

US 2018/0090896 A1 Mar. 29, 2018

(30) Foreign Application Priority Data

Apr. 23, 2015 (JP) ..... 2015-088233

(51) Int. Cl.
*H01R 31/08* (2006.01)
*H01R 13/514* (2006.01)
(Continued)

(52) U.S. Cl.
CPC ..... *H01R 31/08* (2013.01); *H01R 9/2408* (2013.01); *H01R 13/432* (2013.01);
(Continued)

(58) Field of Classification Search
CPC ..... H01R 31/00; H01R 31/08; H01R 9/2408; H01R 13/4223; H01R 13/432; H01R 13/514; H01R 43/048; H01R 43/4223
See application file for complete search history.

(56) References Cited

U.S. PATENT DOCUMENTS 3,512,043 A * 5/1970 Stange ..... H01F 38/28 200/51 R
4,786,258 A * 11/1988 Shaffer ..... H01R 13/7032 200/51.1
(Continued)

FOREIGN PATENT DOCUMENTS

JP 51-4995 1/1976
JP 4-65074 3/1992
(Continued)

OTHER PUBLICATIONS

International Search Report dated Jun. 21, 2016.

*Primary Examiner* — Carl J Arbes
(74) *Attorney, Agent, or Firm* — Gerald E. Hespos; Michael J. Porco; Matthew T. Hespos

(57) ABSTRACT

It is aimed to provide a method and a joint connector for shorting a plurality of wires to each other, the method and the joint connector being capable of flexibly coping with the number of the wires. A joint connector includes a plurality of wire-side terminals (20) to be mounted on a plurality of wires (10), a plurality of insulating housings (30) and a shorting member (40). Each wire-side terminal (20) is inserted into a terminal accommodating chamber of the corresponding insulating housing (30). The plurality of insulating housings (30) are united with each other while
(Continued)

being arranged in a specific arrangement direction. The shorting member (40) is inserted into each of the united insulating housings (30) and fit to each wire-side terminal (20), whereby the wire-side terminals (20) are electrically connected to each other via the shorting member (40).

6 Claims, 11 Drawing Sheets

(51) Int. Cl.

| | |
|---|---|
| ***H01R 9/24*** | (2006.01) |
| ***H01R 13/432*** | (2006.01) |
| ***H01R 43/048*** | (2006.01) |
| ***H01R 43/20*** | (2006.01) |
| *H01R 13/422* | (2006.01) |

(52) U.S. Cl.
CPC ..... *H01R 13/514* (2013.01); *H01R 43/048* (2013.01); *H01R 43/20* (2013.01); *H01R 13/4223* (2013.01)

(56) References Cited

U.S. PATENT DOCUMENTS 4,904,196 A * 2/1990 Sueyoshi ..... H01R 13/7032 200/51.1
5,288,251 A 2/1994 Sumida
5,295,846 A * 3/1994 Sumida ..... H01R 13/436 200/51.1
5,352,129 A * 10/1994 Guglhor ..... H01R 13/7032 439/188
5,464,353 A * 11/1995 Saijo ..... H01R 13/4362 439/188
5,509,817 A * 4/1996 Tsuji ..... H01R 13/7032 200/51.1
5,516,300 A * 5/1996 Tsuji ..... H01R 13/701 200/51 R
5,545,055 A * 8/1996 Tanaka ..... H01R 31/08 439/189
5,651,693 A * 7/1997 Fukuda ..... H01R 13/641 439/188
5,713,759 A * 2/1998 Shinozaki ..... H01R 13/04 439/511
5,897,389 A * 4/1999 Dietz ..... H01R 13/7032 439/188
7,591,665 B2 * 9/2009 Nakamura ..... H01R 13/5812 439/374
7,806,720 B2 * 10/2010 Omori ..... H01R 9/03 439/507
9,054,474 B2 * 6/2015 Omori ..... B60R 16/0207
9,379,472 B2 * 6/2016 Hara ..... H01R 13/05

FOREIGN PATENT DOCUMENTS

| | | |
|---|---|---|
| JP | 5-53154 | 7/1993 |
| JP | 2005-025997 | 1/2005 |
| JP | 2005-322487 | 11/2005 |
| JP | 2014-49399 | 3/2014 |
| JP | 2014-93157 | 5/2014 |
| JP | 2014-112497 | 6/2014 |

* cited by examiner

JOINT CONNECTOR

BACKGROUND

Field of the Invention

The present invention relates to a method for forming a short circuit for electrically shorting a plurality of wires included in a wiring harness of an automotive vehicle and a joint connector for forming the short circuit.

Description of the Related Art

A joint connector is known as a means for shorting a plurality of wires included in a wiring harness of an automotive vehicle. The joint connector includes a plurality of female terminals, i.e. wire-side terminals, to be respectively mounted on the plurality of wires to be shorted to each other, an insulating housing having a plurality of terminal accommodating chambers for receiving the respective wire-side terminals and terminal locking portions for respectively locking the wire-side terminals inserted into the terminal accommodating chambers, and a shorting member provided in the insulating housing.

Japanese Unexamined Patent Publication No. 2014-049399 discloses a shorting member in the form of a busbar formed of a conductor, specifically a metal plate and integrally includes a base portion (coupling portion) and a plurality of terminal fitting portions (male terminals) projecting from this base portion (coupling portion). The respective terminal fitting portions are shaped to be fittable to the plurality of wire-side terminals inserted into the respective terminal accommodating chambers. The base portion of this shorting member allows electrical conduction between the wire-side terminals to be fit to the respective terminal fitting portions, thereby forming a short circuit for shorting the plurality of wires.

However, in the joint connector described in Japanese Unexamined Patent Publication No. 2014-049399, since the number of the terminal accommodating chambers of the insulating housing and the number of the terminal fitting portions of the shorting member corresponding to the terminal accommodating chambers are pre-determined. Thus, a joint connector having a number of terminal accommodating chambers and terminal fitting portions corresponding to the number of wires to be shorted has to be prepared for each short circuit. This impedes the mass production of joint connectors. Further, a corresponding joint connector cannot be prepared until the number of wires is determined and it is difficult to flexibly cope with a change in the number of the wires.

The above inconveniences can be solved, for example, by mass-producing joint connectors having a maximum necessary number of terminal accommodating chambers and terminal fitting portions and using only a necessary number of terminal accommodating chambers and terminal fitting portions in this joint connectors. However, in this case, many redundant terminal accommodating chambers and terminal fitting portions may be possibly left unused in this joint connector, leading to a considerable loss of an installation space and cost of this joint connector.

The present invention aims to provide a method for forming a short circuit for shorting a plurality of wires, the method being capable of flexibly coping with the number of the wires, and a joint connector with excellent mass productivity for forming the short circuit.

SUMMARY

The present invention is directed to a method for forming a short circuit for shorting a plurality of wires. The method includes a terminal mounting step of respectively mounting a plurality of wire-side terminals on ends of the plurality of wires and a terminal inserting step of preparing a plurality of insulating housings respectively corresponding to the wire-side terminals. Each insulating housing includes a terminal accommodating chamber for receiving the wire-side terminal, a terminal locking portion for locking the wire-side terminal inserted into the terminal accommodating chamber, and a shorting member receiving opening for receiving an inserted shorting member for shoring the wire-side terminals to each other to allow the shorting member to contact the wire-side terminal in the terminal accommodating chamber. The wire-side terminals are respectively inserted into the terminal accommodating chambers of the respective insulating housings and locked by the terminal locking portions. The method further includes a uniting step of uniting the plurality of insulating housings such that the shorting member receiving openings of the respective insulating housings are arranged in a specific arrangement direction perpendicular to an axial direction of the wire-side terminals, and a shorting step of inserting the shorting member into the respective shorting member receiving openings of the plurality of insulating housings such that the shorting member extends across the plurality of insulating housings united with each other in the specific arrangement direction and fitting the shorting member to the respective wire-side terminals in the terminal accommodating chambers of the insulating housings, thereby electrically connecting the wire-side terminals to each other via the shorting member.

Further, the present invention is directed to a joint connector for forming a short circuit for shorting a plurality of wires. The joint connector includes a plurality of wire-side terminals to be respectively mounted on ends of the plurality of respective wires, a plurality of insulating housings respectively corresponding to the plurality of wires, and a shorting member formed of a conductor for electrically connecting the wire-side terminals. Each of the insulating housings includes a terminal accommodating chamber for receiving the wire-side terminal, a terminal locking portion for locking the wire-side terminal inserted into the terminal accommodating chamber, a shorting member receiving opening for receiving the inserted shorting member to allow the shorting member to contact the wire-side terminal in the terminal accommodating chamber, and an adjacent housing holding portion for enabling the plurality of insulating housings to be united with each other by holding another insulating housing adjacent in a specific arrangement direction perpendicular to an axial direction of the wire-side terminals with the plurality of insulating housings arranged such that the shorting member receiving openings of the respective insulating housings are arranged in the specific arrangement direction. The shorting member is shaped to be fittable to the respective wire-side terminals by being so inserted into the respective shorting member receiving openings of the plurality of insulating housings as to extend across the plurality of insulating housings united with each other in the specific arrangement direction, and electrically connects the wire-side terminals to each other by being fit.

DETAILED DESCRIPTION

An embodiment of the present invention is described with reference to the drawings.

A method according to this embodiment is provided for forming a short circuit for shorting a plurality of wires 10 to each other and for constructing a joint connector as shown in FIGS. 1 to 7.

First, a basic configuration of the joint connector is described. This joint connector includes a plurality of wire-side terminals 20, a plurality of insulating housings 30 and a shorting member 40.

Figure 4:
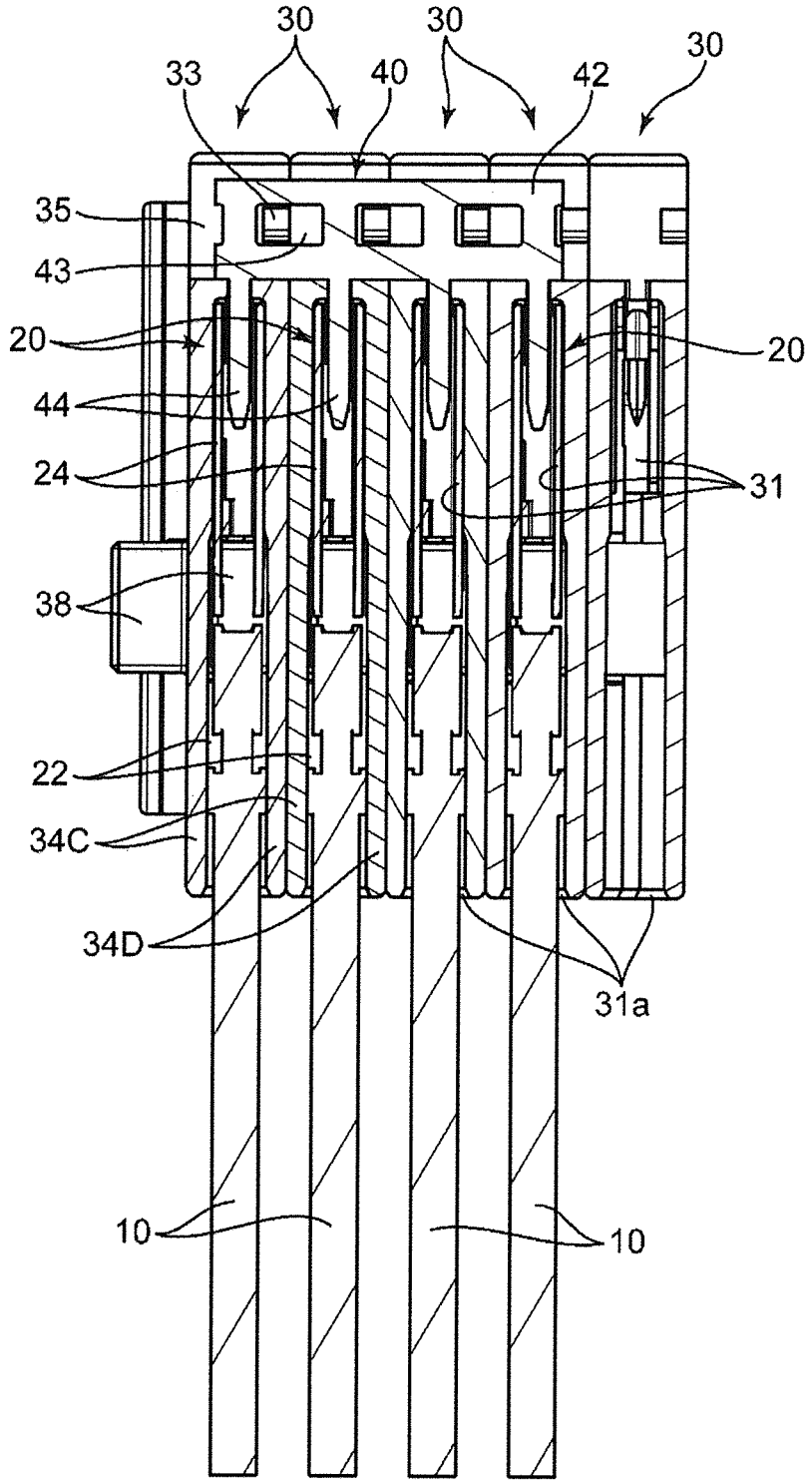
FIG. 4 is a plan view in section along IV-IV of FIG. 1.
Figure 5:
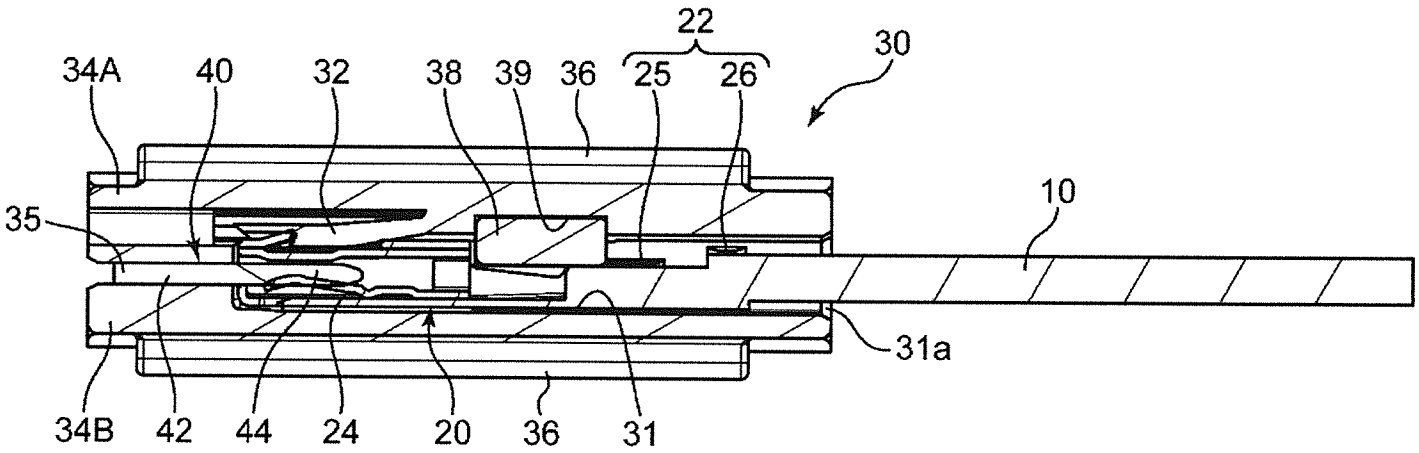
FIG. 5 is a side view in section along V-V of FIG. 1.
Figure 6:
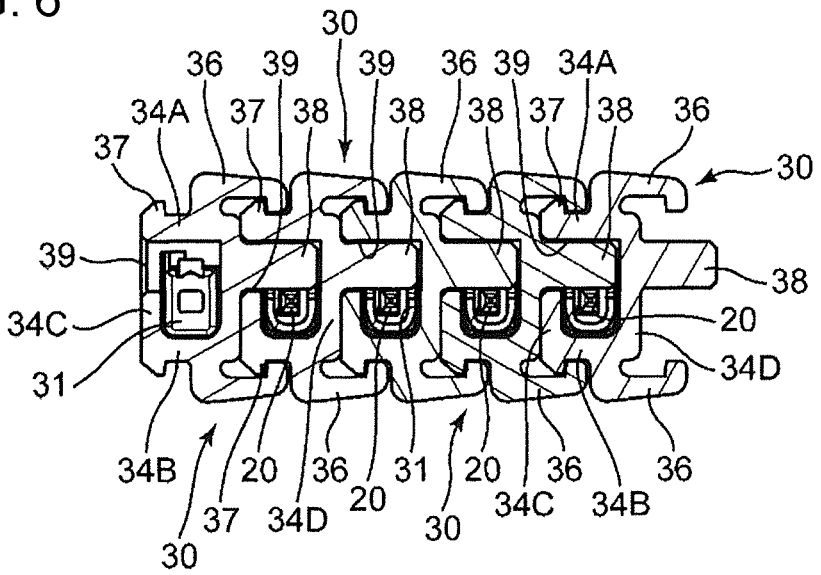
FIG. 6 is a side view in section along VI-VI of FIG. 2.

The plurality of wire-side terminals 20 are respectively mounted on ends of the plurality of wires 10 as shown in FIGS. 4 and 5. Each wire-side terminal 20 according to this embodiment is a so-called female terminal and includes a wire crimping portion 22 and an electrical contact portion 24. The wire crimping portion 22 and the electrical contact portion 24 are formed of a single metal plate.

The wire crimping portion 22 is crimped to the end of the wire 10 and includes a conductor barrel 25 and an insulation barrel 26. The conductor barrel 25 is crimped to a conductor part exposed at the end of the wire 10 to embrace the conductor part, and the insulation barrel 26 is crimped to an insulation coating covering a conductor behind the exposed conductor part to embrace the insulation coating. However, a specific mounting mode of the wire-side terminal on the wire is not limited in the present invention.

The electrical contact portion 24 is a part configured to electrically contact the shorting member 40 to form electrical conduction with the shorting member 40 by being fit to the shorting member 40. The electrical contact portion 24 according to this embodiment is a female type and receives the shorting member 40 fit thereinto. The shorting member 40 is described in detail later.

The plurality of insulating housings 30 are shaped identically to each other in this embodiment, are prepared for each wire-side terminal 20 and can be arranged and united with each other in a direction (lateral direction of FIGS. 1, 4, 6 and 7), which is a specific arrangement direction set in advance and perpendicular to an axial direction of the wire-side terminals 20.

Each insulating housing 30 is integrally formed of an insulating material such as synthetic resin, and includes a plurality of side walls surrounding a terminal accommodating chamber 31 and a locking lance 32 serving as a terminal locking portion for locking the wire-side terminal inserted into the terminal accommodating chamber 31. The plurality of side walls include a pair of side walls 34C, 34D arranged in the specific arrangement direction and a pair of side walls 34A, 34B arranged in a direction perpendicular to the specific arrangement direction. Outer side surfaces of the side walls 34C, 34D are facing side surfaces facing 34C, 34D insulating housings 20 in the lateral direction of claim 1 adjacent in the specific arrangement direction in the united state. Outer side surfaces of the side walls 34A, 34B are non-facing side surfaces 34A, 34B facing in the vertical direction of FIG. 1) perpendicular to the specific arrangement direction.

The terminal accommodating chamber 31 includes a terminal insertion opening 31*a* perpendicular to the side walls 34A to 34D and open on one side (right side of FIGS. 2 and 5; hereinafter, referred to as a "rear side") in the axial direction, and receives the wire-side terminal 20 inserted along the axial direction through this terminal insertion opening 31*a*. As shown in FIG. 5, the locking lance 32 extends into the terminal accommodating chamber 31 from the side wall 34A, is deflectable and deformable in a direction perpendicular to the axial direction, and locks the wire-side terminal 20 by engaging a suitable part, e.g. the electrical contact portion 24, of the wire-side terminal 20 inserted into the terminal accommodating chamber 31 as described above.

Each insulating housing 30 includes a shorting member receiving opening 35. The shorting member receiving opening 35 is open on a side (left side of FIGS. 2 and 5; hereinafter, referred to as a "front side") opposite to the terminal insertion opening 31*a* in the axial direction and receives the inserted shorting member 40 to allow the shorting member 40 to contact the electrical contact portion 24 of the wire-side terminal 20 in the terminal accommodating chamber 31. Specifically, according to this embodiment, the shorting member receiving opening 35 is in the form of a groove crossing a front part of the insulating housing 30 along the specific arrangement direction and is connected to the front end of the terminal accommodating chamber 31.

Each insulating housing 30 further includes a pair of adjacent housing holding portions 36 and a pair of ribs 37 serving as a pair of held portions to be held by the adjacent housing holding portions 36. The respective adjacent housing holding portions 36 and ribs 37 are formed on the pair of non-facing side surfaces 34A, 34B and laterally arranged side by side on the non-facing side surfaces. The ribs 37 project further outward than the facing side surfaces and extend along the axial direction. The adjacent housing holding portions 36 are shaped to embrace the ribs 37 of another housing 30 adjacent in the specific arrangement direction with the plurality of insulating housings 30 arranged in the specific arrangement direction as shown in FIGS. 1 to 7, and hold the insulating housing 30 including the embraced ribs 37 by embracing the ribs 37.

Each insulating housing 30 further includes a secondary locking portion 38 and a secondary locking portion receiving opening 39 for receiving the secondary locking portion 38.

The secondary locking portion 38 is shaped to lock the wire-side terminal 20 in the terminal accommodating chamber 31 of another insulating housing 30 adjacent in the specific arrangement direction separately from the locking lance 32 with the plurality of insulating housings 30 arranged and united with each other in the specific arrangement direction. Specifically, the secondary locking portion 38 according to this embodiment is a projection projecting toward the adjacent insulating housing 30 (i.e. outward) from the outer side surface of the side wall 34C, which is one of the pair of facing side surfaces.

The secondary locking portion receiving opening 39 is formed to penetrate through the side wall 34D, which is the other of the pair of facing side surfaces, and enables secondary locking of the wire-side terminal 20 by the secondary locking portion 38 by receiving the inserted secondary locking portion 38 of the other insulating housing 30 adjacent in the specific arrangement direction. Specifically, each secondary locking portion 38 engages a specific part of the wire-side terminal 20 inserted in the terminal accommodating chamber 31, e.g. the rear end of the wire-side terminal 20 by being inserted into the terminal accommodating chamber 31 of the other insulating housing 30 through the secondary locking portion receiving opening 39 of the adjacent other insulating housing 30, thereby secondarily locking the wire-side terminal 20 in this other insulating housing 30.

The shorting member 40 is formed of a conductor and includes a base portion 42 and a plurality of terminal fitting portions 44. The shorting member 40 according to this embodiment is formed of a single flat metal plate. The base portion 42 is shaped to have a constant width and extend in the specific arrangement direction in an assembled state. The plurality of terminal fitting portions 44 are arranged at intervals in a longitudinal direction of the base portion 42 and project in the specific arrangement direction perpendicular to the longitudinal direction of the base portion 42. An arrangement interval of the terminal fitting portions 44 is set equal to an arrangement interval of the terminal accommodating chambers 31 in a state where the plurality of insulating housings 30 are united.

Figure 7:
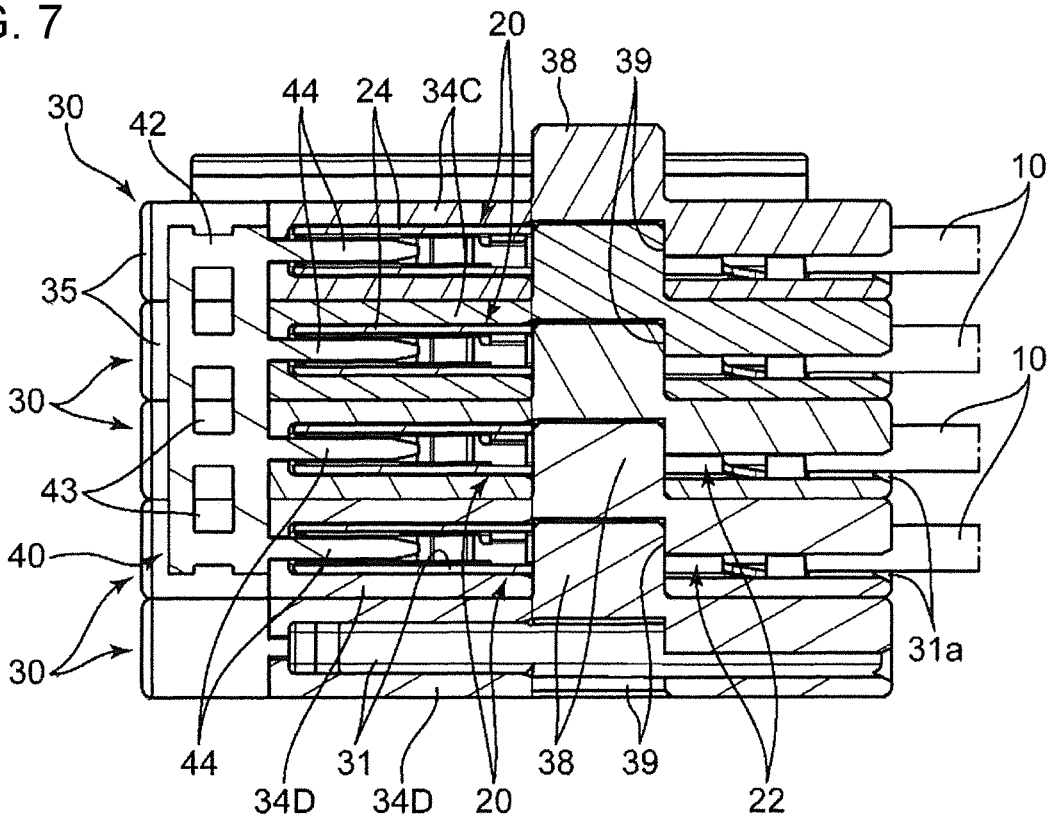
FIG. 7 is a front view in section along VII-VII of FIG. 2.

The shorting member 40 is shaped to be able to short the plurality of wire-side terminals 20 to each other, i.e. shaped to be fit to the female electrical contact portions 24 of the respective wire-side terminals 20 by being fit into the respective insulating housings 30 through the shorting member receiving opening 35. Specifically, the base portion 42 can be inserted into the groove-like shorting member receiving openings 35 to extend across the respective united insulating housings 30 in the specific arrangement direction united as shown in FIGS. 4 and 7. The plurality of terminal fitting portions 44 are fit as male terminals into the female electrical contact portions 24, thereby being able to electrically contact these electrical contact portions 24.

Next, the method for forming the short circuit using this joint connector and assembling this joint connector is described. The method includes a terminal mounting step, a terminal inserting step, a uniting step and a shorting step described below.

1) Terminal Mounting Step

In the terminal mounting step, the plurality of wire-side terminals 20 are respectively mounted on the ends of the plurality of wires 10. Specifically, the conductor barrel 25 and the insulation barrel 26 in the wire crimping portion 22 of the wire-side terminal 20 are respectively crimped to the conductor part exposed at the end of the wire 10 and the insulation coating behind this exposed conductor part. In this way, the wire-side terminal 20 can be electrically connected to the conductor part.

2) Terminal Inserting Step

Figure 8:
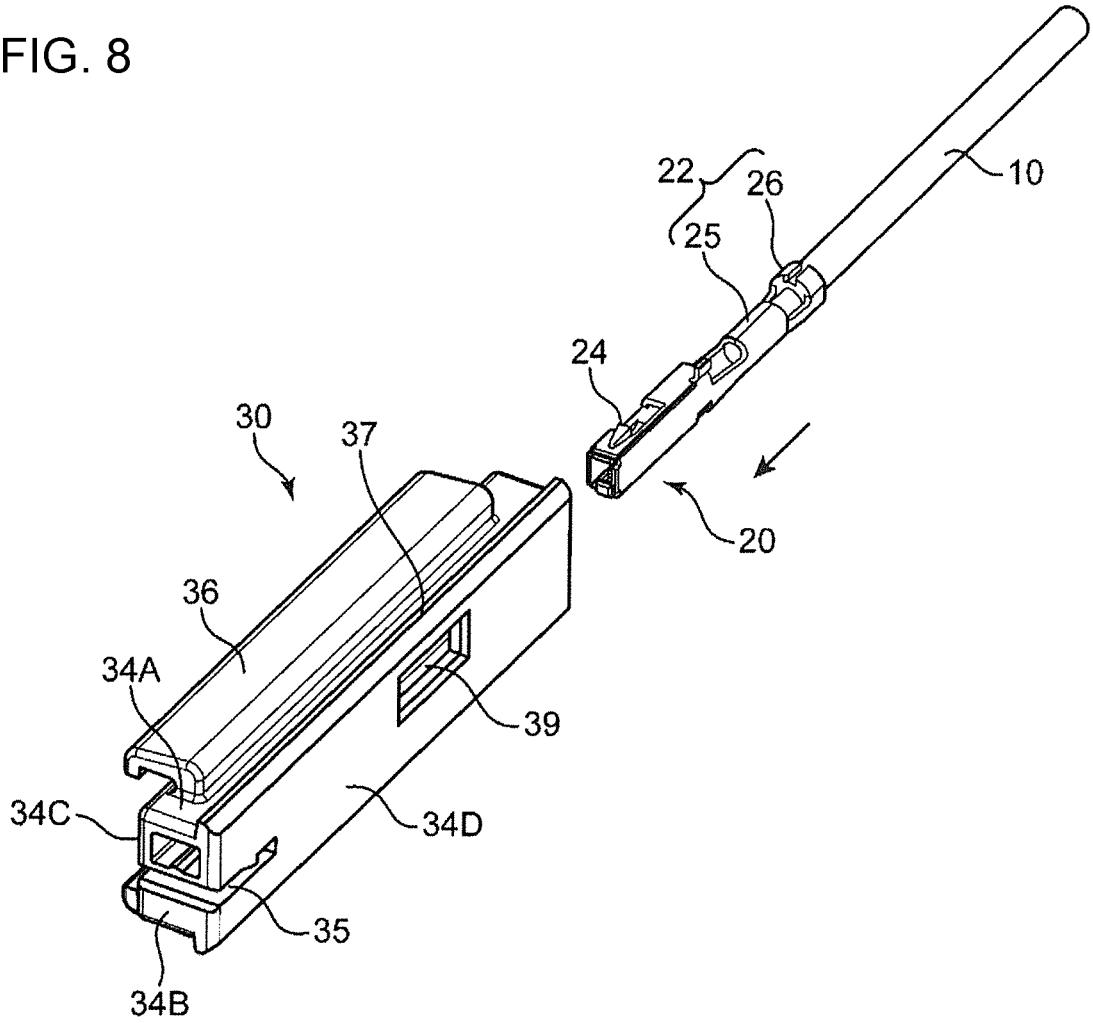
FIG. 8 is a perspective view showing a terminal inserting step of a method for forming a short circuit according to the embodiment.

In the terminal inserting step, a number of insulating housings 30 equal to a number of the wires 10 and the wire-side terminals 20 mounted on the wires 10 are prepared and the wire-side terminals 20 are respectively inserted into these insulating housings 30, as shown in FIG. 8. Specifically, the wire-side terminal 20 is inserted into the terminal accommodating chamber 31 of the insulating housing 30 through the terminal insertion opening 31*a*, which is an opening end on the rear side, with the electrical contact portion 24 in the lead, and primarily locked by the locking lance 32 formed in the insulating housing 30.

When this terminal inserting step is performed for all the wire-side terminals 20, the wire-side terminals 20 are respectively individually protected by the corresponding insulating housings 30. Thus, the breakage of the wire-side terminals 20 due to direct contact of the wire-side terminals 20 with other members in steps subsequent to this terminal inserting step is prevented.

3) Uniting Step

In the uniting step, the plurality of insulating housings 30 are united with each other. This uniting step may be performed before or during the terminal inserting step, but is more preferably performed after the completion of the terminal inserting step in terms of protection of the wire-side terminals 20.

Figure 9:
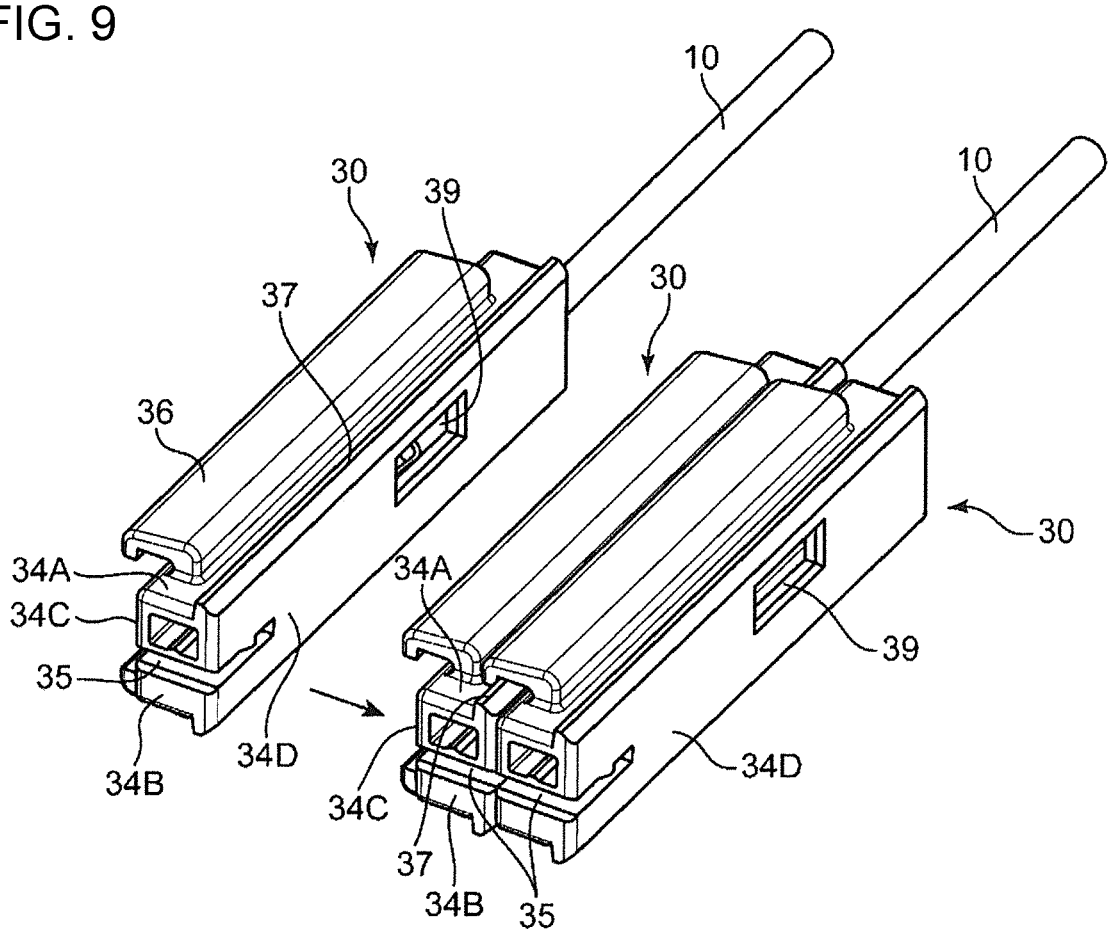
FIG. 9 is a perspective view showing a uniting step of the method.
Figure 10:
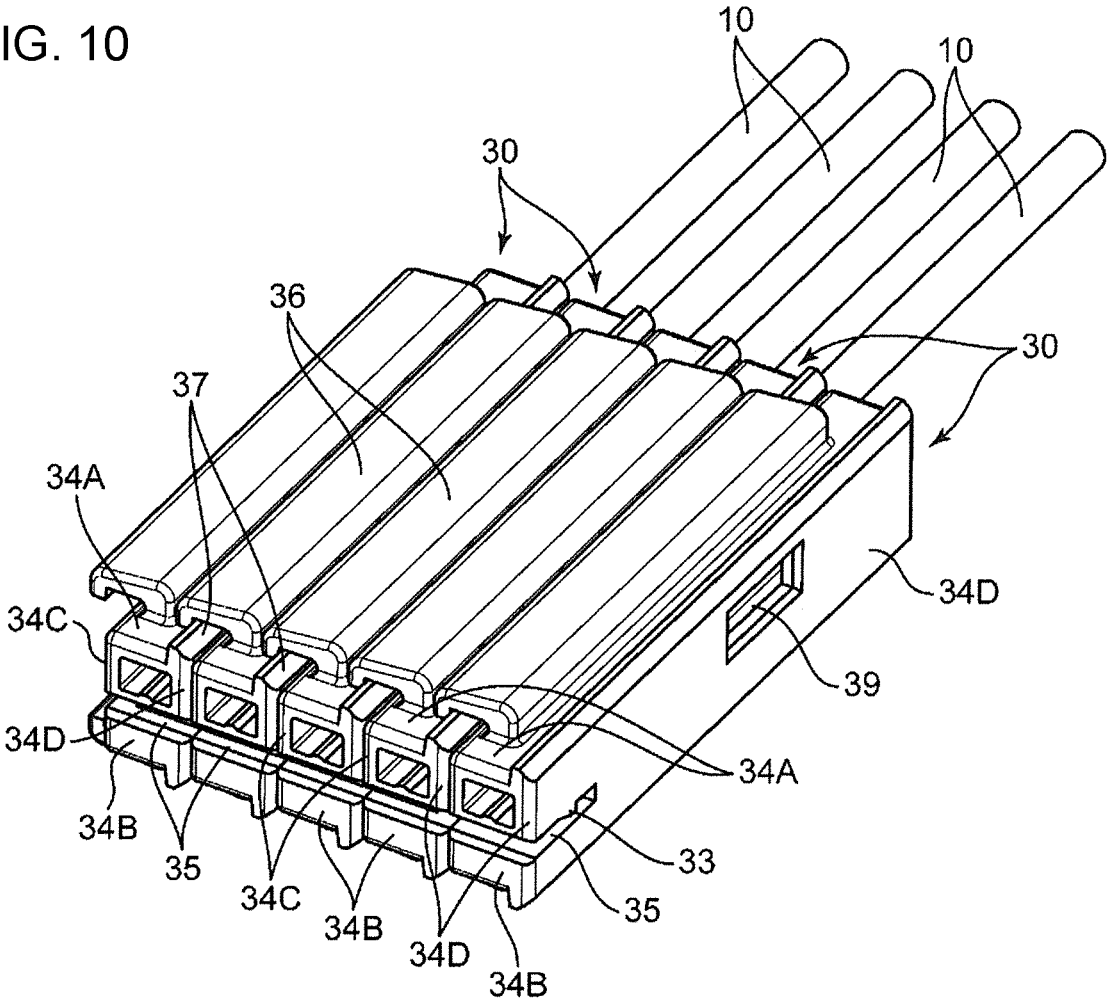
FIG. 10 is a perspective view showing a state after the uniting step of the method is completed.

In the uniting step, all the insulating housings 30 are united as shown in FIG. 10 by repeating an operation of attaching the insulating housing 30 to be adjacent in the specific arrangement direction to one insulating housing 30 as shown in FIG. 9. Specifically, the both insulating housings 30 are brought closer to each other such that the outer side surface of the side wall 34D, which is the other facing side surface 34D, of the adjacent other insulating housing 30 is caused to face the outer side surface of the side wall 34C, which is the one facing side surface 34C, of the one insulating housing 30, and the both insulating housings 30 are united with each other by engaging the pair of adjacent housing holding portions 36 of the one insulating housing 30 with the ribs 37 of the other insulating housing 30 such that the adjacent housing holding portions 36 move over the ribs while being resiliently deformed.

At this time, the secondary locking portion 38 of the one insulating housing 30 is inserted into the terminal accommodating chamber 31 of the other insulating housing 30 through the secondary locking portion receiving opening 39 of the other insulating housing 30 and engages the wire-side terminal 20 primarily locked in the terminal accommodating chamber 31, whereby the wire-side terminal 20 is secondarily locked. Thus, in this joint connector, each wire-side terminal 20 can be secondarily locked utilizing the insulating housing 30 adjacent to the corresponding insulating housing 30 without preparing another member (so-called retainer) for secondary locking different from the insulating housing 30.

Further, the insertion of the secondary locking portion 38 of the other insulating housing 30 into the secondary locking portion receiving opening 39 of the one insulating housing 30 enables the both insulating housings 30 to be relatively positioned in a direction perpendicular to the specific arrangement direction.

Note that, out of the plurality of insulating housings 30, the insulating housing 30 having no adjacent insulating housing 30 on the side of the secondary locking portion receiving opening 39 thereof, i.e. the insulating housing 30 on one end in the specific arrangement direction, is an empty insulating housing 30 (wire-side terminal 20 is not inserted)

only for the purpose of secondarily locking the insulating housing 30 as shown in FIG. 9.

This uniting step can also be performed even if the adjacent housing holding portions 36 are omitted. For example, an adhesive tape may be wound around the plurality of insulating housings 30 arranged in the specific arrangement direction.

4) Shorting Step

Figure 11:
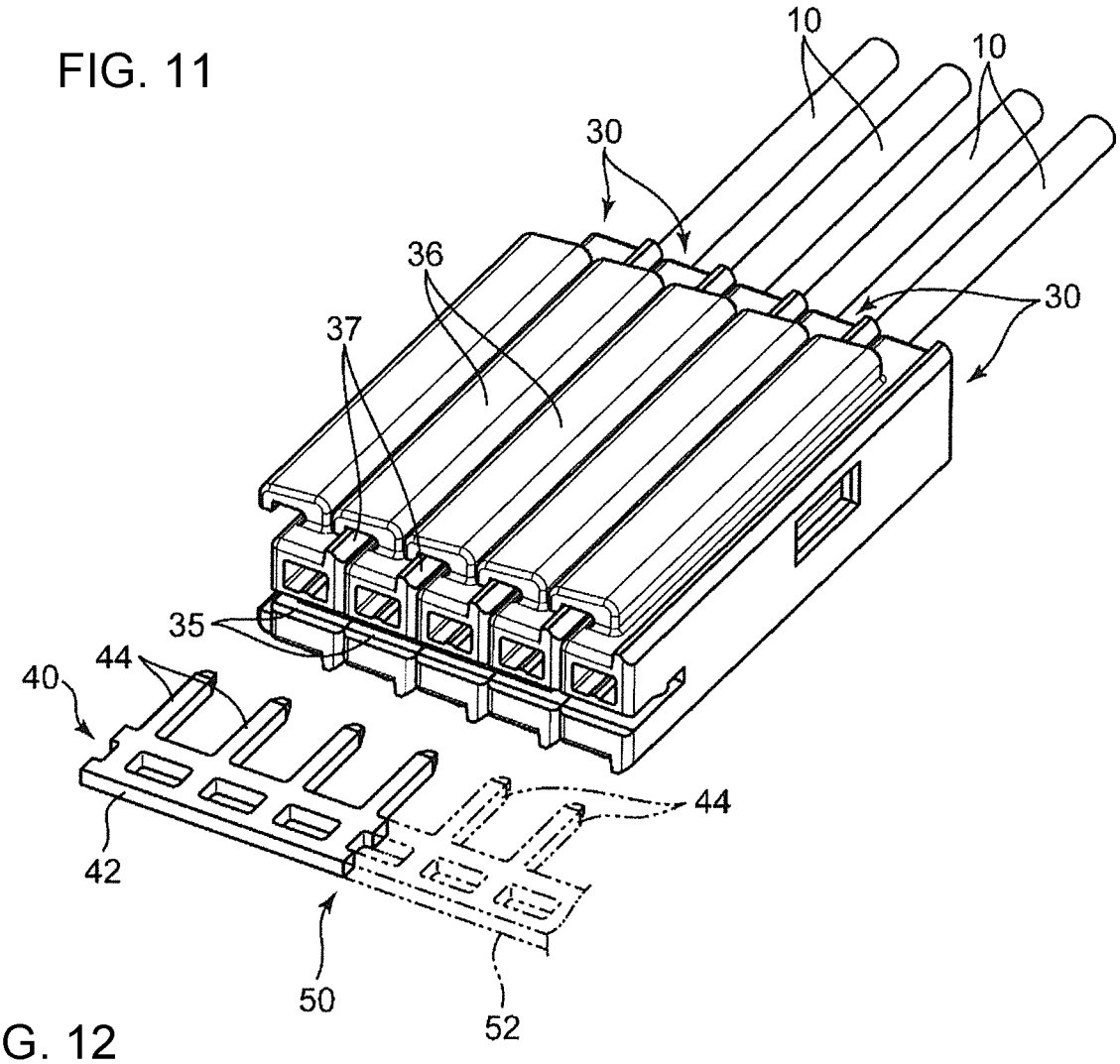
FIG. 11 is a perspective view showing a shorting step of the method.

In the shorting step, the shorting member 40 is inserted into the respective shorting member receiving openings 35 of the plurality of insulating housings 30 united with each other with the respective terminal fitting portions 44 of the shorting member 40 in the lead as shown in FIG. 11. The base portion 42 of the shorting member 40 is accommodated into the shorting member receiving openings 35 to cross the respective insulating housings 30 in the specific arrangement direction, i.e. such that the shorting member 40 extends across the respective insulating housings 30 in the specific arrangement direction. On the other hand, the respective terminal fitting portions 44 can be fit to the electrical contact portions 24 of the wire-side terminals 20 in the terminal accommodating chambers 31 of the insulating housings 30. By fitting the plurality of wire-side terminals 20 and the corresponding terminal fitting portions 44 in this way, electrical conduction between the wire-side terminals 20 can be achieved via the shorting member 40.

Figure 1:
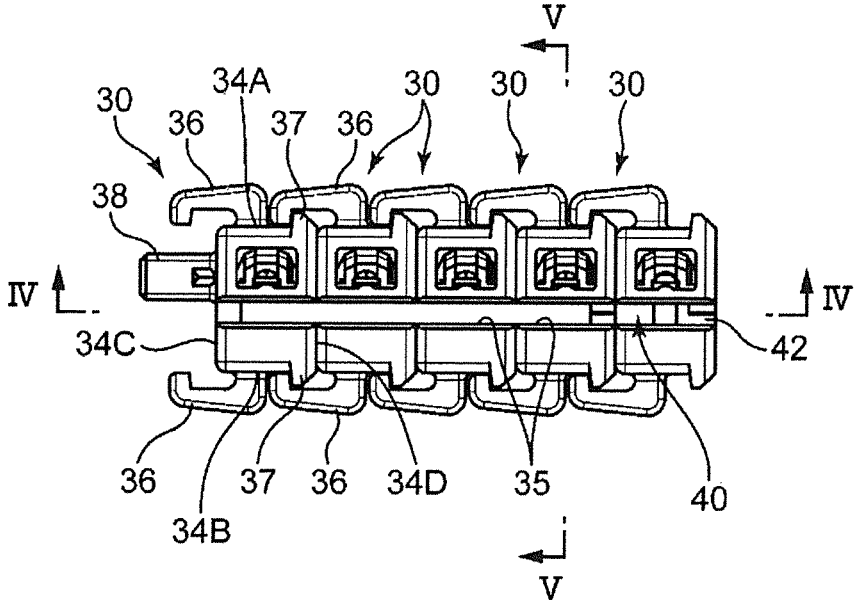
FIG. 1 is an assembled front view of a joint connector according to an embodiment of the present invention.
Figure 2:
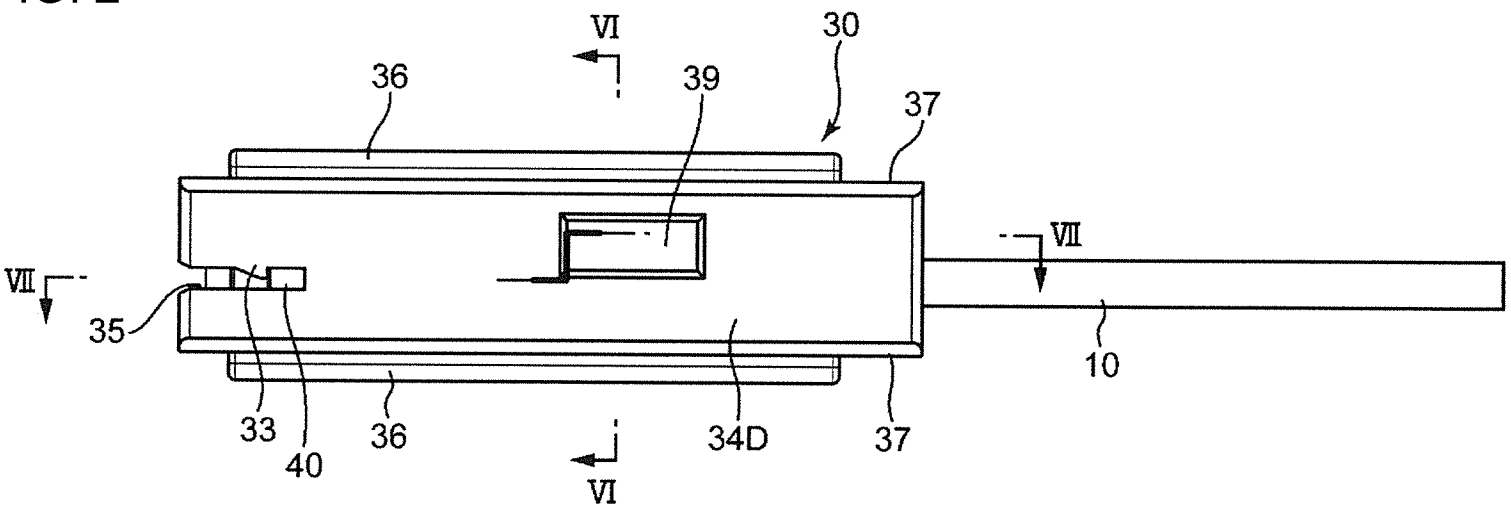
FIG. 2 is an assembled left side view of the joint connector.
Figure 3:
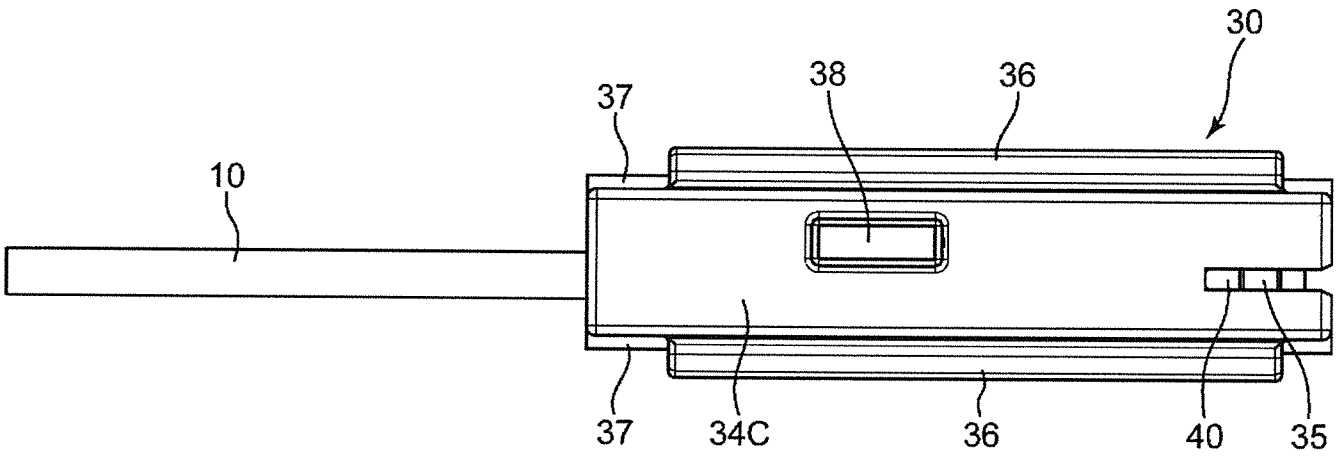
FIG. 3 is an assembled right side view of the joint connector.

The shorting member 40 may be fixed to the respective insulating housings 30 merely by press-fitting or by the engagement of engaging portions set in advance. For example, the shorting member 40 may be fixed by the engagement of projections 33 formed on the insulating housings 30 and through holes 43 formed in the base portion 42 as shown in FIGS. 2 and 4.

The shorting member 40 can be easily supplied, for example, by preparing a shorting material 50 as shown by solid and chain double-dashed lines in FIG. 11. This shorting material 50 includes a base portion constituting part 52 extending in one direction and terminal fitting portions 44 sufficiently more than the terminal fitting portions 44 used in the shorting step, and these terminal fitting portions 44 project in the same direction from the base portion constituting part 52. If such a shorting material 50 is prepared, the shorting member 40 including the base portion 42 and a necessary number of the terminal fitting portions 44 as shown by solid line in FIG. 11 can be easily obtained by cutting such a base portion constituting part 52 at a suitable position. That is, the preparation of this shorting material 50 enables a suitable shorting member 40 having as many terminal fitting portions 44 as the number of necessary terminal fitting portions 44 to be quickly obtained when the number of the necessary terminal fitting portions 44 is determined.

With the short circuit forming method and the joint connector described above, a favorable short circuit matching the number of the wires 10 can be formed by flexibly coping with the number of the wires 10. For example, even if the number of the wires 10 is changed, it is possible to construct a suitable joint connector corresponding to the changed number by changing the numbers of the wire-side terminals 20 and the insulating housings 30 used according to an increase or decrease of the number. Thus, there are not many redundant (i.e. unused) terminal accommodating chambers and terminal fitting portions as in conventional joint connectors. Further, by making the shapes of the plurality of insulating housings 30 identical to each other, the mass production of the insulating housings 30 is possible.

Note that the present invention is not limited to the above described embodiment and, for example, also encompasses the following modes.

Figure 12:
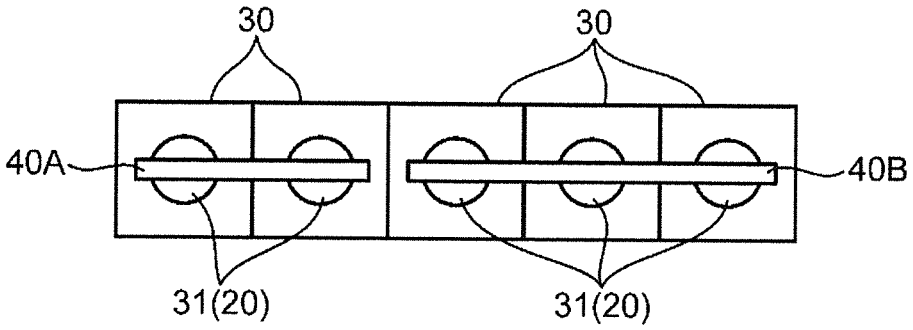
FIG. 12 is a schematic front view showing a first modification of the joint connector.

The present invention is not limited to a mode in which wire-side terminals in all insulating housings are shorted by a single shorting member. For example, as shown in FIG. 12, wire-side terminals 20 respectively supposed to belong to a plurality of short circuits can be shorted to each other for each short circuit by using a plurality of shorting members 40A, 40B.

Figure 13:
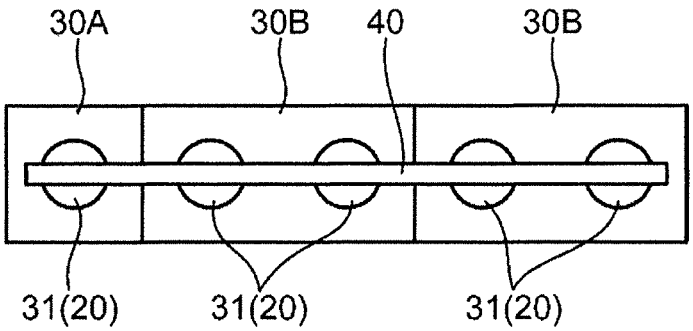
FIG. 13 is a schematic front view showing a second modification of the joint connector.
Figure 14:
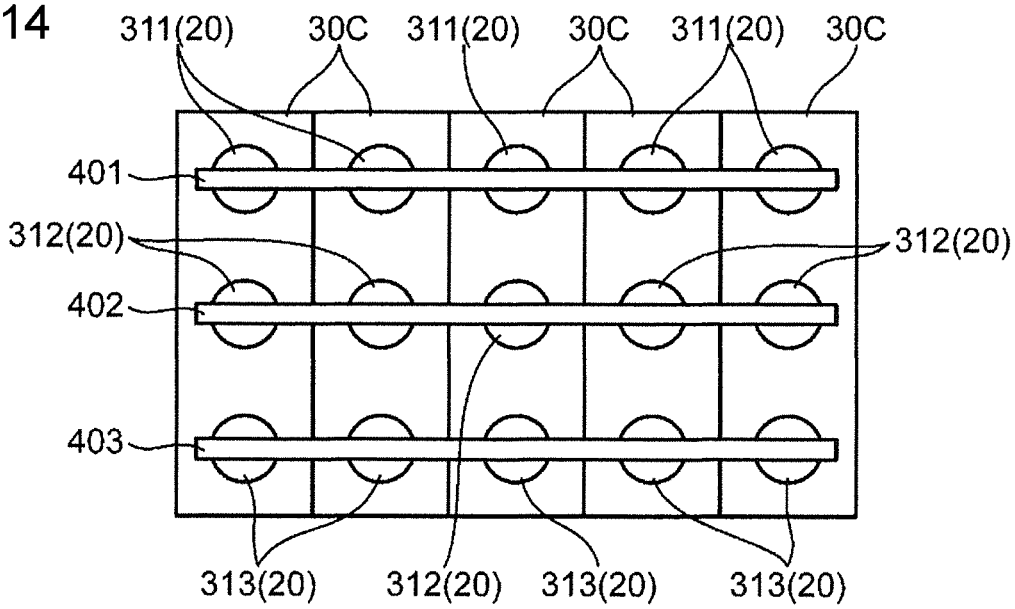
FIG. 14 is a schematic front view showing a third modification of the joint connector.

The insulating housing according to the present invention is not necessarily limited to the one including a single terminal accommodating chamber. For example, as shown in FIG. 13, an insulating housing 30A including a single terminal accommodating chamber and insulating housings 30B each including two terminal accommodating chambers may be used in combination. Alternatively, like a plurality of insulating housings 30C shown in FIG. 14, each insulating housing may include n (n is a natural number not smaller than 2; n=3 in an example shown in FIG. 14) terminal accommodating chambers 311, 312, . . . , 31*n* for accommodating wire-side terminals to constitute a first, second, . . . or nth short circuit, and these terminal accommodating chambers 311, 312, . . . , 31*n* may be arranged in a direction perpendicular to the specific arrangement direction. After these insulating housings 30C are united, shorting members 401, 402, . . . , 40*n* prepared for each short circuit are respectively inserted into the corresponding terminal accommodating chambers 311, 312, . . . , 31*n* and fit to the corresponding wire-side terminals in such a manner as to extend across the respective insulating housings 30C in the specific arrangement direction, whereby n short circuits are formed.

The adjacent housing holding portions of each insulating housing may be formed on parts other than the non-facing side surfaces, e.g. on the facing side surfaces. However, the adjacent housing holding portions are interposed between body parts of the insulating housings adjacent to each other in this case. In contrast, the adjacent housing holding portions formed on the non-facing side surfaces as in the above embodiment can hold the adjacent insulating housings without being interposed between the body parts of the insulating housings adjacent to each other. Thus, the intervals between the insulating housings in the specific arrangement direction can be shortened without leading to structural complication, and a dimension in the specific arrangement direction of the entire joint connector after uniting can be made smaller.

The shorting member is not limited to including the base portion 42 and the plurality of terminal fitting portions 44. For example, the shorting member may be a long metal member extending in the specific arrangement direction and may be fit to electrically contact the respective wire-side terminals by being inserted into the shorting member receiving openings of the respective insulating housings to penetrate through the respective insulating housings and the respective wire-side terminals held in the respective insulating housings in the specific arrangement direction.

As described above, a method for forming a short circuit for shorting a plurality of wires, the method being capable of flexibly coping with the number of the wires, and a joint connector for forming the short circuit, the joint connector being excellent in mass productivity, are provided.

The method to be provided for forming a short circuit for shorting a plurality of wires includes a terminal mounting step of respectively mounting a plurality of wire-side terminals on ends of the plurality of wires, a terminal inserting step of preparing a plurality of insulating housings respectively corresponding to the wire-side terminals, each insulating housing including a terminal accommodating chamber for receiving the wire-side terminal, a terminal locking portion for locking the wire-side terminal inserted into the terminal accommodating chamber, and a shorting member receiving opening for receiving an inserted shorting member for shoring the wire-side terminals to each other to allow the shorting member to contact the wire-side terminal in the terminal accommodating chamber, and respectively inserting the wire-side terminals into the terminal accommodating chambers of the respective insulating housings and locking the wire-side terminals by the terminal locking portions, a uniting step of uniting the plurality of insulating housings such that the shorting member receiving openings of the respective insulating housings are arranged in a specific arrangement direction perpendicular to an axial direction of the wire-side terminals, and a shorting step of inserting the shorting member into the respective shorting member receiving openings of the plurality of insulating housings such that the shorting member extends across the plurality of insulating housings united with each other in the specific arrangement direction and fitting the shorting member to the respective wire-side terminals in the terminal accommodating chambers of the insulating housings, thereby electrically connecting the wire-side terminals to each other via the shorting member.

Further, a joint connector to be provided for forming a short circuit for shorting a plurality of wires includes a plurality of wire-side terminals to be mounted on ends of the plurality of respective wires, a plurality of insulating housings respectively corresponding to the plurality of wires, and a shorting member formed of a conductor for electrically connecting the wire-side terminals. Each of the insulating housings includes a terminal accommodating chamber for receiving the wire-side terminal, a terminal locking portion for locking the wire-side terminal inserted into the terminal accommodating chamber, a shorting member receiving opening for receiving the inserted shorting member to allow the shorting member to contact the wire-side terminal in the terminal accommodating chamber, and an adjacent housing holding portion for enabling the plurality of insulating housings to be united with each other by holding another insulating housing adjacent in a specific arrangement direction perpendicular to an axial direction of the wire-side terminals with the plurality of insulating housings arranged such that the shorting member receiving openings of the respective insulating housings are arranged in the specific arrangement direction. The shorting member is shaped to be fittable to the respective wire-side terminals by being so inserted into the respective shorting member receiving openings of the plurality of insulating housings as to extend across the plurality of insulating housings united with each other in the specific arrangement direction, and electrically connects the wire-side terminals to each other by being fit.

In the above short circuit forming method and joint connector, the plurality of insulating housings respectively corresponding to the plurality of wire-side terminals to be respectively mounted on the ends of the wires are used, and the shorting member is inserted into the respective shorting member receiving openings and fit to the wire-side terminals with the insulating housings united with each other such that the shorting member receiving openings of the insulating housings are arranged in the specific arrangement direction, thereby achieving electrical conduction between the wire-side terminals and further the short-circuiting of the wires. Thus, the short circuit can be formed by flexibly coping with the number of the wires. For example, even if the number of the wires is changed, such a change can be coped with only by changing the numbers of the wire-side terminals and the terminal fitting portions used according to an increase or decrease of that number. Therefore, it is not necessary to provide many redundant (i.e. unused) terminal accommodating chambers and terminal fitting portions as in conventional joint connectors. Further, since the number of the wires can be coped with by changing the number of the plurality of insulating housings used, the mass production of the insulating housings is possible.

In the short circuit forming method, the terminal inserting step is more preferably performed before the uniting step. This enables the respective wire-side terminals to be individually protected by the respective insulating housings before the uniting step.

For example, the shorting step preferably includes preparing the shorting member integrally including a base portion extending in the specific arrangement direction and a plurality of terminal fitting portions projecting from the base portion in the same direction perpendicular to the specific arrangement direction, each terminal fitting portion being shaped to be fittable to the wire-side terminal by being inserted into the shorting member receiving opening, and fitting the respective terminal fitting portions of the shorting member to the wire-side terminals in the terminal accommodating chambers of the insulating housings by inserting the terminal fitting portions of the shorting member into the respective shorting member receiving openings of the plurality of insulating housings united with each other such that the base portion of the shorting member extends across the respective insulating housings in the specific arrangement direction.

In this case, the shorting step can include preparing a shorting material formed of a conductor and integrally including a base portion constituting part extending in one direction and more terminal fitting portions than the number of the terminal fitting portions used in the shorting step, the terminal fitting portions projecting from the base portion constituting part in the same direction, and forming the shorting member including the base portion and a necessary number of the terminal fitting portions by cutting the base portion constituting part of the shorting material at a suitable position. In this method, a favorable shorting member corresponding to the number of the wires can be obtained only by a simple operation of cutting the base portion constituting part of the shorting material prepared in advance at a position corresponding to the necessary number of the terminal fitting portions.

Further, preferably, the shorting member of the joint connector integrally includes a base portion extending in the specific arrangement direction and a plurality of terminal fitting portions projecting from the base portion in the same direction perpendicular to the specific arrangement direction, each terminal fitting portion is shaped to be fittable to the wire-side terminal by being inserted into the shorting member receiving opening, and the respective terminal fitting portions of the shorting member are fit to the wire-side terminals in the terminal accommodating chambers of the insulating housings by being inserted into the respective shorting member receiving openings of the plurality of insulating housings united with each other such that the base portion of the shorting member extends across the respective insulating housings in the specific arrangement direction, thereby electrically connecting the wire-side wires to each other.

In the joint connector, preferably, each insulating housing includes a secondary locking portion, and the secondary locking portion is shaped to lock the wire-side terminal in the terminal accommodating chamber of the insulating housing adjacent in the specific arrangement direction separately from the terminal locking portion with the plurality of insulating housings united with each other. As just described, each insulating housing including the secondary locking portion for secondarily locking the wire-side terminal in the insulating housing adjacent to this insulating housing eliminates the need to prepare a special member for the secondary locking, e.g. a retainer which is a constituent member different from the insulating housing and mounted into the insulating housing for the secondary locking and enables each wire-side terminal to be secondarily locked regardless of the numbers of the wires and the wire-side terminals.

In this case, preferably, each insulating housing has a facing side surface facing the insulating housing adjacent in the specific arrangement direction, the secondary locking portion is shaped to project from the facing side surface toward the adjacent insulating housing, each insulating housing includes a secondary locking portion receiving opening enabling the wire-side terminal to be secondarily locked by the secondary locking portion by receiving the secondary locking portion of the adjacent insulating housing inserted thereinto, and the insulating housings adjacent to each other are relatively positioned in a direction perpendicular to the specific arrangement direction by the insertion of the secondary locking portion into the secondary locking portion receiving opening. This enables the plurality of insulating housings to be reliably positioned by a rational structure utilizing the secondary locking portion.

Further, preferably, each insulating housing has a pair of non-facing side surfaces facing in a direction perpendicular to the specific arrangement direction, the adjacent housing portion is formed on each of the pair of non-facing side surfaces and shaped to hold the adjacent insulating housing by engaging the non-facing side surface of the adjacent insulating housing. As just described, the formation of the adjacent housing holding portions not on the surfaces of each insulating housing facing in the specific arrangement direction, but on the non-facing side surfaces facing in the direction perpendicular to the specific arrangement direction enables intervals between the insulating housings to be narrowed in the specific arrangement direction and enables a dimension in the specific arrangement direction of the entire connector after uniting to be reduced.

The invention claimed is:

1. A method for forming a short circuit for shorting a plurality of wires, comprising:

mounting a plurality of wire-side terminals respectively on ends of the plurality of wires;

providing a plurality of insulating housings respectively corresponding to the plurality of wire-side terminals, each of the plurality of insulating housings including a terminal accommodating chamber for receiving the wire-side terminal, a terminal locking portion for locking the wire-side terminal inserted into the terminal accommodating chamber, and a shorting member receiving opening;

inserting the plurality of wire-side terminals into the terminal accommodating chambers of the respective insulating housings and locking the wire-side terminals by the terminal locking portions;

uniting each of the plurality of insulating housings to at least one other one of the insulating housings such that the shorting member receiving openings of the respective insulating housings are arranged in a specific arrangement direction perpendicular to an axial direction of the wire-side terminals; and inserting the shorting member into the respective shorting member receiving openings of the plurality of insulating housings such that the shorting member extends across the plurality of insulating housings united with each other in the specific arrangement direction and such that the shorting member is fit to the respective wire-side terminals in the terminal accommodating chambers of the insulating housings, thereby electrically connecting the wire-side terminals to each other via the shorting member.

2. A joint connector for forming a short circuit for shorting a plurality of wires, comprising:

a plurality of wire-side terminals to be respectively mounted on ends of the plurality of respective wires;

a plurality of insulating housings respectively corresponding to the plurality of wires; and a shorting member formed of a conductor for electrically connecting the plurality of wire-side terminals;

wherein:

each of the plurality of insulating housings includes a terminal accommodating chamber for receiving one of the wire-side terminals, a terminal locking portion for locking the wire-side terminal inserted into the terminal accommodating chamber, a shorting member receiving opening for receiving the inserted shorting member to allow the shorting member to contact the wire-side terminal in the terminal accommodating chamber, an adjacent housing holding portion and a held portion, the adjacent housing holding portion of one of the insulating housings being engageable with the held portion of another of the insulating housings for enabling the plurality of insulating housings to be united with each other by holding another insulating housing adjacent in a specific arrangement direction perpendicular to an axial direction of the plurality of wire-side terminals with the plurality of insulating housings arranged such that the shorting member receiving openings of the respective insulating housings are arranged in the specific arrangement direction; and the shorting member is shaped to be fittable to the respective wire-side terminals in the terminal accommodating chambers of the insulating housings by being so inserted into the respective shorting member receiving openings of the plurality of insulating housings as to extend across the plurality of insulating housings united with each other in the specific arrangement direction, and electrically connects the wire-side terminals to each other by being fit.

3. The joint connector of claim 2, wherein the shorting member integrally includes a base portion extending in the specific arrangement direction and a plurality of terminal fitting portions projecting from the base portion in the same direction perpendicular to the specific arrangement direction, each terminal fitting portion is shaped to be fittable to the wire-side terminal by being inserted into the shorting member receiving opening, and the respective terminal fitting portions of the shorting member are fit to the wire-side terminals in the terminal accommodating chambers of the insulating housings by being inserted into the respective shorting member receiving openings of the plurality of insulating housings united with each other such that the base portion of the shorting member extends across the respective insulating housings in the specific arrangement direction, thereby electrically connecting the wire-side terminals.

4. The joint connector of claim 2, wherein each insulating housing includes a secondary locking portion, and the secondary locking portion is shaped to lock the wire-side terminal in the terminal accommodating chamber of the insulating housing adjacent in the specific arrangement direction separately from the terminal locking portion with the plurality of insulating housings united with each other.

5. The joint connector of claim 4, wherein each insulating housing has a facing side surface facing the insulating housing adjacent in the specific arrangement direction, the secondary locking portion is shaped to project from the facing side surface toward the adjacent insulating housing, each insulating housing includes a secondary locking portion receiving opening enabling the wire-side terminal to be secondarily locked by the secondary locking portion by receiving the secondary locking portion of the adjacent insulating housing inserted thereinto, and the insulating housings adjacent to each other are relatively positioned in a direction perpendicular to the specific arrangement direction by the insertion of the secondary locking portion into the secondary locking portion receiving opening.

6. The joint connector of any one of claim 2, wherein each insulating housing has a pair of non-facing side surfaces facing in a direction perpendicular to the specific arrangement direction, and the adjacent housing portion is formed on each of the pair of non-facing side surfaces and shaped to hold the adjacent insulating housing by engaging the non-facing side surface of the adjacent insulating housing.

* * * * *